US005404927A

United States Patent [19]

Bailey

[11] Patent Number: 5,404,927

[45] Date of Patent: Apr. 11, 1995

[54] OVERHEAD GARAGE DOOR BOTTOM BRACKET

[75] Inventor: Bobby G. Bailey, Trenton, Ohio

[73] Assignee: Clopay Building Products Company, Inc., Cincinnati, Ohio

[21] Appl. No.: 60,254

[22] Filed: May 12, 1993

[51] Int. Cl.[6] ..... E05D 15/06

[52] U.S. Cl. ..... 160/201; 160/193; 16/97

[58] Field of Search ..... 160/201, 191, 192, 193, 160/265; 16/97; 5/299, 293; 248/220.1, 222.4, 300

[56] References Cited

U.S. PATENT DOCUMENTS

| | | | |
|---|---|---|---|
| 857,850 | 6/1907 | Vallone | 5/299 |
| 1,341,068 | 5/1920 | Okun | 5/299 |
| 2,008,959 | 7/1935 | Johnson . | |
| 2,072,514 | 3/1937 | Daniell | 160/191 X |
| 2,291,583 | 7/1942 | Rowe . | |
| 2,436,006 | 2/1948 | Kaiser | 160/191 |
| 2,442,309 | 5/1948 | Nurberg | 160/193 |
| 2,495,672 | 1/1950 | Dautrick | 160/191 |
| 2,684,846 | 7/1954 | Beall | 160/193 |
| 2,694,214 | 11/1954 | Hammer | 16/97 |
| 3,071,400 | 1/1963 | Bellock | 248/222.4 X |
| 3,090,427 | 5/1963 | Stroup et al. | 160/40 |
| 3,354,934 | 11/1967 | Stansberry | 160/209 |
| 3,412,780 | 11/1968 | Moler | 160/191 |
| 3,548,425 | 12/1970 | Goldstein | 5/299 |
| 4,095,641 | 6/1978 | Olson | 160/209 |
| 4,158,998 | 6/1979 | Clement | 211/291 X |

FOREIGN PATENT DOCUMENTS

| | | | |
|---|---|---|---|
| 207692 | 12/1923 | United Kingdom | 5/299 |

*Primary Examiner*—Blair M. Johnson
*Attorney, Agent, or Firm*—Wood, Herron & Evans

[57] ABSTRACT

A bottom bracket for an overhead garage door having a spring tension assisted lift system. The bottom bracket has protrusions that interlock with mating slots in the stile of the garage door bottom panel thus preventing the bracket from detaching from the garage door when the bracket is attached to the spring under tension, even if the bracket fastening screws are removed.

26 Claims, 3 Drawing Sheets

OVERHEAD GARAGE DOOR BOTTOM BRACKET

FIELD OF THE INVENTION

The present invention relates generally to overhead garage door bottom brackets and specifically to a system for preventing a bottom bracket from separating from a garage door when the bracket is connected to a door lift spring under tension.

BACKGROUND

Multi-panel overhead garage doors are used to provide a convenient and compact means for access to garages. However, it is difficult for an individual to lift the door because of its weight. In addition, after the door has been lifted, it is necessary to prevent the door from returning to a closed position until so desired by the individual.

To solve these problems, springs have been used. These springs are either directly connected to a bottom bracket which is in turn secured to the bottom panel of the garage door as shown in Dautrick U.S. Pat. No. 2,495,672, or they are connected to the bottom bracket through a cable or other flexible means as shown in Johnson U.S. Pat. No. 2,008,959. In either case, when the door is down or closed, the spring is at its maximum stretch or torsion and is under relatively high tension. This tension provides enough lift to allow an ordinary person to easily lift or open the garage door. As the door is lifted, the panels move into a horizontal position along a track thereby reducing the portion of the door tending to resist the lift. At the same time, the spring stretch is being reduced. Nevertheless, when the door is in the up or open position, the tension in the spring is sufficient to prevent the garage door from closing without initiation by a person.

In all of the prior art systems, the bottom bracket is secured to the garage door end stile or bottom panel solely by screws (Kaiser U.S. Pat. No. 2,436,006), bolts (Moler U.S. Pat. No. 3,412,780), or other removable devices. Although these devices serve to adequately secure the bottom bracket to the door, a problem arises if they are loosened or removed.

If the fastening devices are removed, the bottom bracket becomes disengaged from the garage door. This can be safely done if the spring or cable has first been disengaged. If, however, the fastening devices are removed (or disengage on their own) while the spring is attached and under high tension (as when the door is in the closed position), a potentially catastrophic event can occur. The bottom bracket then becomes a projectile acting under the full force of the spring. Any nearby person could be seriously injured if such an event occurred.

Therefore, there is a significant need for a means of preventing the bottom bracket from separating from the garage door when the bottom bracket is attached to the springs under tension and the fastening devices are removed. Further, these means should not hinder in the attachment and removal of the bracket from the garage door when the bracket is not secured to the spring.

SUMMARY OF INVENTION

In accordance with this invention, an overhead garage door bottom bracket is disclosed which comprises three primary components. The first is for releasably securing the bracket to the bottom panel of an overhead garage door; the second is for connecting the bracket to a door lift spring that is under tension; and the third is for preventing the bottom bracket from separating from the garage door when the bottom bracket is attached to the lift spring under tension and the first component is removed.

The first component is any standard releasable fastening device such as screws or bolts. Overlapping apertures are located in the bottom bracket and garage door end stile or bottom panel for receiving these fastening devices. Although any number of fastening devices may be used, two are preferable. Because the third component, which will be discussed below, aids in securing the bottom bracket to the garage door, fewer fastening devices are needed to safely secure the bracket to the door than are needed on conventional brackets. Whereas three or more fastening devices are needed with conventional brackets, two are sufficient with the present invention.

The second component can be any structure suitable for attaching a lift spring to the bracket. The preferred structure comprises a cylindrical body attached to the stile side of the bracket with a larger diameter cylindrical cap on the end.

The third component operates in conjunction with the first two components and consists of at least one male protrusion or projection on the bottom bracket or garage door (end stile or bottom panel) and at least one female receptacle on the opposing part (garage door (end stile or bottom panel) or bottom bracket). The male protrusion has a narrow throat and a bulbous head while the female receptacle is a keyhole shape having a bulbous opening and a narrow throat extending vertically upward therefrom. Thus the male protrusions mate with the female receptacles thereby interlocking the bottom bracket with the garage door bottom panel through a sliding interference fit.

Although any number of male protrusions and female receptacles are suitable, preferably two should be used. If only one is used, the resulting structure may have insufficient strength to hold the bracket to the garage door if the fastening devices are removed while the door lift spring is attached and under tension. Alternatively, three or more provide no additional safety while adding to the cost and complexity of the bracket.

Finally, the bracket itself is a single piece, L-shaped flange having a pair of rings integrally formed from the front face for securing a standard door roller to the bracket. Although the male protrusions may be on either the bracket or garage door, it is preferable that they be integrally formed from the flange. In addition, placing both male protrusions on the stile side of the flange and both apertures for the fastening devices on the front side of the flange is also preferred. Because the lift spring is secured to the stile side of the flange, by placing the male protrusions thereon they are in-line with the force acting on the flange due to the lift spring. This force urges the male protrusion into the narrow throat of the female receptacle securing the bracket to the door.

Thus, the disclosed invention prevents a garage door bottom bracket from detaching from a garage door when the bracket is attached to a door lift spring under tension and the fastening devices are removed. As such, the disclosed invention is able to prevent potentially catastrophic injuries. With current bottom brackets, several individuals have received serious injuries to their head and eyes when they removed the fastening devices while the bracket was connected to the door lift spring under tension. When the fastening devices are removed, conventional bottom brackets are released from the garage door and become projectiles acting under the tension in the lift spring, a considerable force. In contrast, bottom brackets using the disclosed invention remain securely and safely attached to the garage door when the fastening devices are removed, thereby eliminating the danger associated with current bottom brackets.

BRIEF DESCRIPTION OF THE DRAWINGS

The invention can best be described by reference to the drawings in which.

DETAILED DESCRIPTION

Figure 1:
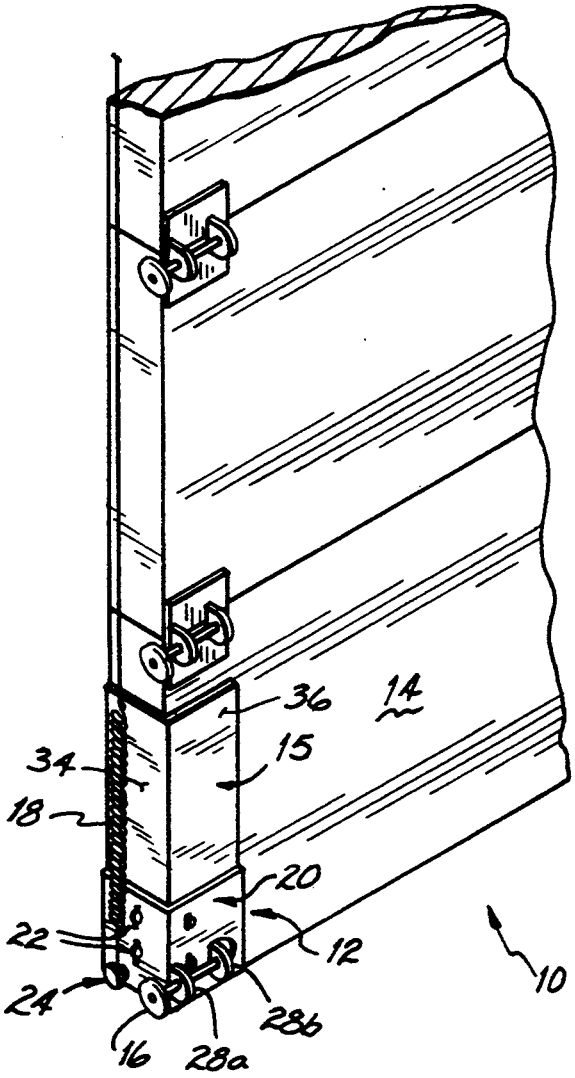
FIG. 1 is a fragmentary perspective view of the garage door bottom bracket attached to a multipanel, hinged garage door.

Referring first to FIG. 1 of the drawings, the presently preferred embodiment of the garage door bottom bracket 12 is shown attached to the end stile 15 which is in turn fixedly secured to a bottom panel 14 of a multipanel, hinged garage door 10. However, it should be recognized that the bracket 12 could be releasably secured directly to a garage door bottom panel 14 without use of an end stile 15. Secured to the bottom bracket 12 is a standard door roller 16 for guiding the garage door 10 during opening and closing, and a lift spring 18 for assisting in opening and closing the door. The tension in the lift spring 18 is at its maximum when the door is in the closed position and is at its minimum when the door is in the open position.

Figure 2:
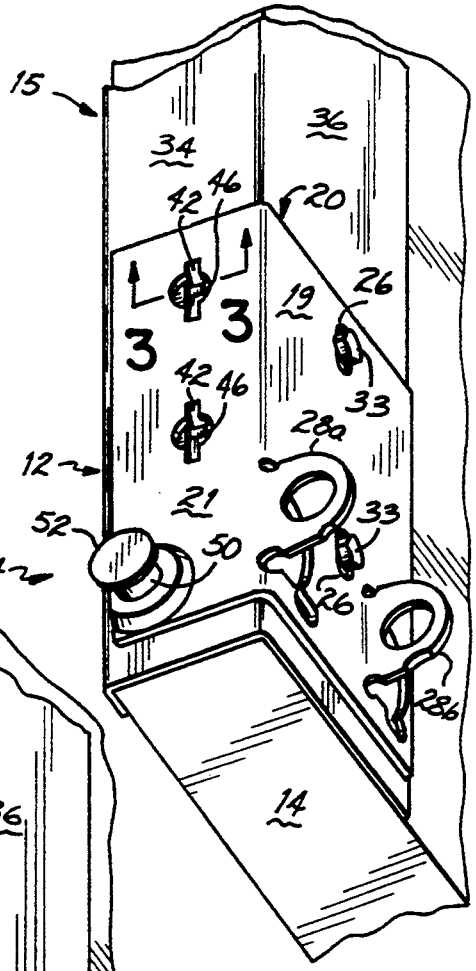
FIG. 2 is a perspective view of the garage door bottom bracket attached to the garage door bottom panel.
Figure 4:
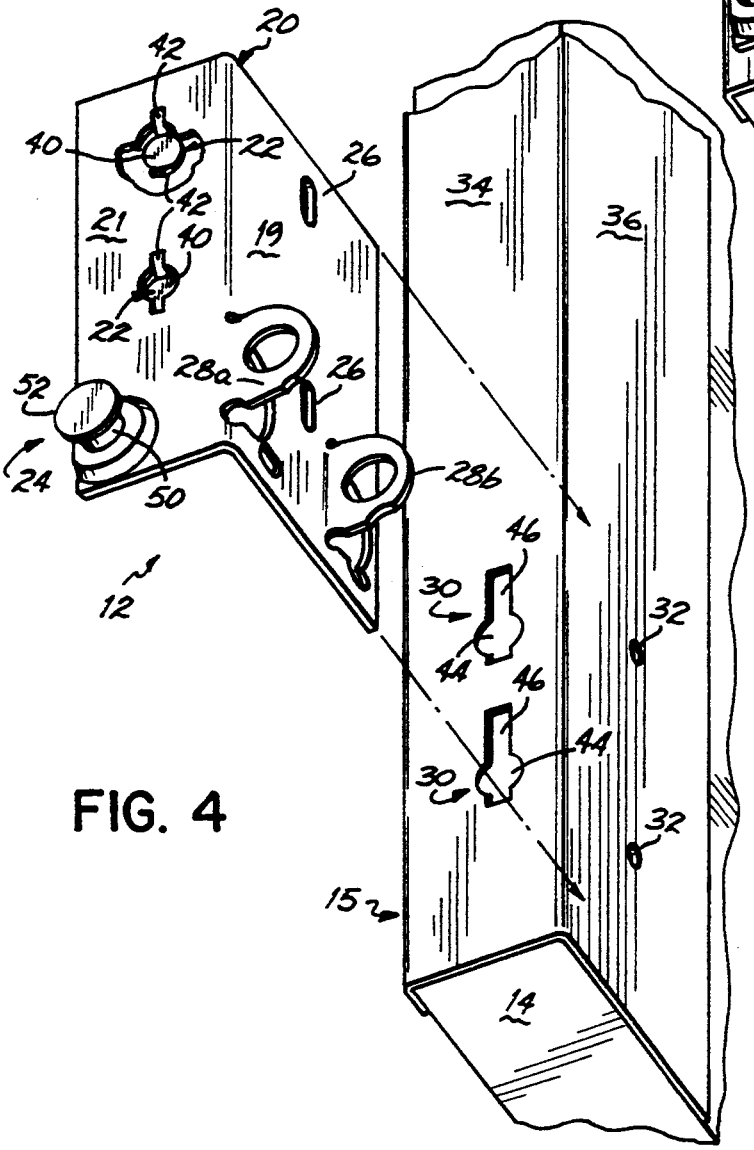
FIG. 4 is a perspective view, partially broken away, of the garage door bottom bracket and garage door bottom panel.

As shown in FIGS. 2 and 4, the bottom bracket 12 is comprised of a generally L-shaped flange 20. This flange 20 overlays a part of the back 36 and side 34 of the garage door end stile 15. It is preferred that this flange be formed from a single metal sheet, although two bonded sheets could be used.

A device 24 is provided for attaching the lift spring 18 directly or through a cable to the bottom bracket 12. The preferred device 24 has an elongated cylindrical body 50 with an enlarged head 52. Where a metal bracket 12 is employed, the device 24 is secured to a metal flange 20 by welding or swaging at a location formed in the flange for that purpose. Of course, the entire bottom bracket 12 may be molded in one piece, but presently where the device 24 is formed independently of the flange, the manufacturing process may be simplified to reduce the cost of the bracket 12.

The bracket 12 also secures a standard garage door track roller 16 by means of two rings **28*a*, 28*b* formed from the surface of the flange 20 that overlays the back of the garage door end stile 15. These rings 28*a*, 28*b* are made substantially perpendicular to the flange surface from which they are formed to decrease the complexity of manufacture and ensure that the roller 16 will remain secured to the bottom bracket 12**.

Slots 26 are formed in the bottom bracket 12 and holes 32 are formed in the end stile 15 for passage of screws, bolts, or other fastening devices 33. For a traditional bracket, typically around three to five screws or bolts have been necessary to secure the bracket to the garage door. With the present invention, this number has been reduced to two, although additional fastening devices could be used. The slots 26 can be in either surface of the flange, but the preferred location is in the back surface 19 rather than the side surface 21.

The preferred means for preventing the bottom bracket 12 from separating from the garage door end stile 15 when the bracket is connected to the lift spring under tension includes male projections 22 on the bottom bracket 12 and corresponding female receptacles 30 on the garage door end stile 15 (note that the bottom bracket 12 could be secured directly to the bottom panel 14, but it is preferred to secure it to an end stile 15 which is fixedly secured to the bottom panel 14). These projections 22 and receptacles 30 interlock to secure the bottom bracket 12 to the garage door end stile 15.

Although any appropriate structure for interlocking the bracket and garage door may be used (i.e., an interlocking dove-tail structure), the preferred structure is a "keyhole" arrangement in which a female receptacle 30 comprises a bulbous or enlarged opening 44 with a narrow slot 46 extending therefrom. The corresponding male projection 22 comprises a narrow throat 42 and a bulbous head 40. To interlock the components, the male projection is inserted into the female receptacle bulbous opening 44. Then the male projection 22 is moved relative to the female receptacle 30 such that the male projection narrow throat 42 enters the female receptacle narrow slot 46, interlocking the components. The extent of this sliding interference fit is determined by the length of the female receptacle narrow slot 46.

To ensure that the keyhole interlocking structure prevents the bottom bracket 12 from separating from the garage door bottom panel 14 when the lift spring 18 is attached and under tension, the female receptacle narrow slot 46 should extend from the bulbous opening 44 in a direction generally towards the force in the spring (vertically upward). This permits the tension in the spring to bias the bottom bracket 12 towards an interlocked position.

The disclosed invention is particularly advantageous for use on garage doors that are constructed from wood or thin sheets of metal or plastic. The "keyhole" 30 can be made by simply punching or cutting the keyhole shape into the sheet from which the end stile 15 (if one is used) and door are formed. No special provisions are required to accommodate the male projection bulbous head when the bracket is interlocked with the garage door because the head merely rests behind the thin wall in the door's hollow cavity.

Figure 3:
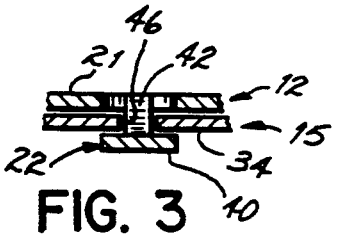
FIG. 3 is a sectional view taken on line 3—3 of FIG. 2.

The male projection 22 is preferably integrally formed with the bracket 12. Referring to FIG. 3, the male projection 22 is constructed by stamping it out of the wall of the bottom bracket 12. This has the advantage of rendering the male projection 22 permanently affixed to the bracket and also simplifies the manufacturing process. The male projection 22 is formed by first cutting two outlines in the bracket side wall 21. These outlines are mirror images of each other separated by a width substantially equal to the width of the female receptacle narrow slot 46. The outline consists of an arc having two lines parallel to the line of reflection emanating from the endpoints. The center of these outlines is then pushed inward a distance substantially equal to the thickness of the bottom bracket 12 and garage door end stile 15; the bottom bracket 12 and garage door stile wall 34; or the bottom bracket 12, garage door end stile 15, and garage door side wall 34 combined depending upon the type of door used. The result is a male projection having a bulbous head 40 and a narrow body consisting of a tab 42 at either end of the bulbous head 40.

Figure 5:
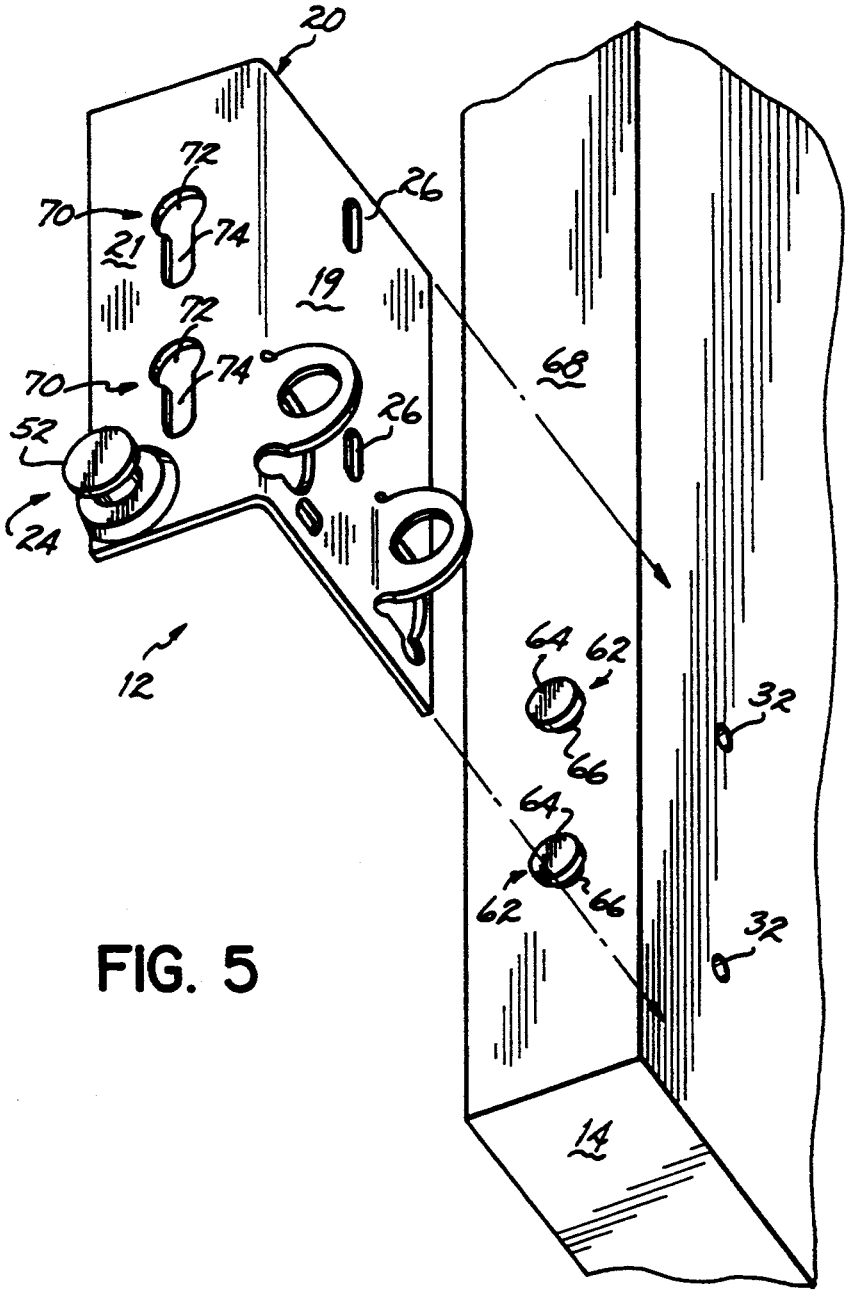
FIG. 5 is a perspective view, partially broken away, of an alternate embodiment of the garage door bottom bracket and garage door bottom panel.

An alternate embodiment, shown in FIG. 5, is preferable for use on solid wooden garage doors, but may be used for both metal and plastic doors. In this embodiment, the male projections 62 are secured directly to the stile surface 68 of the garage door bottom panel 14. It is preferred that the male projections 62 be screwed directly onto the bottom panel 14, but any means for fixedly securing the male projections 62 may be used. The female receptacles 70 are located on the bracket side wall 21. The male projections 62 have a bulbous head 64 and narrow throat 66 that mate with the bulbous opening 72 and narrow slot 74 of the female receptacles 70. In this embodiment, the narrow slot 74 should extend from the bulbous opening 72 in a direction generally away from the force in the door lift spring 18 (FIG. 1) to ensure that the interlocking structure prevents the bottom bracket 12 from separating from the garage door bottom panel 14. This arrangement permits the tension in the spring to bias the bottom bracket 12 towards an interlocked position.

Any number of interlocking male projections 22 and female receptacles 30 can be used, but two are preferred. Also, it is preferred that the female receptacles be on the side 34 of the garage door. This places the interlocking components substantially in line with the door lift spring 18.

In use, the bottom bracket 12 is placed onto the garage door end stile 15 by inserting the male projections 22 into the female receptacles 30. Then the bottom bracket 12 is moved relative to the garage door in the direction of the female receptacle narrow throat 46 to the full extent of the interference fit. The screws, bolts or other fastening devices 33 are then secured to the bottom bracket 12 and the garage door end stile 15/bottom panel 14. At this point, the door lift spring 18 and track roller 16 are attached to the bottom bracket 12. If the fastening devices 33 are subsequently removed while the door lift spring 18 is attached to the bottom bracket 12, the male/female interlocking devices 22, 30 prevent the bottom bracket 12 from separating from the garage door end stile/bottom panel 14. Thus, the potentially catastrophic separation of the bottom bracket from the door under spring tension has been overcome by the principles of this invention.

Having described the invention, other embodiments will become apparent to a person of ordinary skill in the art and such are within the scope of the invention.

What is claimed is:

1. An overhead garage door bottom bracket for assisting the door lift in a spring tensioned system comprising:

a garage door bottom bracket;

first means for releasably securing said bracket to the door bottom;

second means for connecting said bracket to a door lifting spring under tension; and third means for releasably interlocking said bracket to the door bottom, said third means adapted to interlock said bracket with the door bottom when said bracket is connected to the lift spring under tension and to be easily released from the door bottom when said bracket is not connected to the lift spring under tension.

2. The bracket of claim 1 wherein said third means comprises:

at least one male protrusion on said bracket for interlocking said bracket to at least one female receptacle on the door bottom by sliding interference fit.

3. The bracket of claim 2 wherein said male protrusion has a narrow throat and a bulbous head adapted to be received by the female receptacle.

4. The bracket of claim 1 wherein said third means comprises:

at least one female receptacle on said bracket for interlocking said bracket to at least one male protrusion on the door bottom by sliding interference fit.

5. The bracket of claim 4 wherein said female receptacle has a bulbous opening with a narrow throat extending therefrom adapted to receive the male protrusion.

6. The bracket of claim 2 wherein there are a plurality of the female receptacles on the door, said bracket having a plurality of said male protrusions.

7. The bracket of claim 6 wherein there are two of the female receptacles on the door, said bracket having two of said male protrusions.

8. The bracket of claim 1 wherein said first means comprises a flange with an aperture for at least one threaded fastening device

9. The bracket of claim 8 wherein said flange has two apertures for two of said threaded fastening devices.

10. The bracket of claim 1 wherein said second means comprises:

an elongated body extending from said bracket having an enlarged head for securing said spring.

11. The bracket of claim 2 wherein said bottom bracket comprises one piece having:

two intersecting planar surfaces that are substantially perpendicular to one another; and a pair of rings integrally formed from and substantially perpendicular to one of said planar surfaces for securing a standard door roller to said bottom bracket.

12. The bracket of claim 11 wherein one of said planar surfaces includes at least one slot adapted to permit said first means to releasably secure said bracket to the door bottom and the other of said planar surfaces includes said at least one male protrusion and said second means integrally formed therewith.

13. An overhead garage door bottom bracket for assisting the door lift in a spring tensioned system comprising:

first and second substantially perpendicularly intersecting planar surfaces;

a ring formed from and substantially perpendicular to said first planar surface for securing a standard door roller to said bottom bracket;

at least one slot in said first planar surface to permit passage of at least one threaded fastening device for releasably securing said bottom bracket to a garage door;

an elongated body extending from said second planar surface for securing said bracket to a door lifting spring under tension; and at least one male protrusion having a narrow throat and a bulbous head on said second planar surface for interlocking said bottom bracket to at least one female receptacle on the door bottom through sliding interference fit thereby preventing said bracket from releasing from said door bottom when said bracket is secured to said spring under tension.

14. An overhead garage door bottom bracket for assisting the door lift in a spring tensioned system comprising:

first and second substantially perpendicularly intersecting planar surfaces;

a ring formed from and substantially perpendicular to said first planar surface for securing a standard door roller to said bottom bracket;

at least one slot in said first planar surface to permit passage of at least one threaded fastening device for releasably securing said bottom bracket to a garage door;

an elongated body extending from said second planar surface for securing said bracket to a door lifting spring under tension; and at least one female receptacle on said second planar surface for interlocking said bottom bracket to at least one male protrusion having a narrow throat and a bulbous head on the door bottom through sliding interference fit thereby preventing said bracket from releasing from said door bottom when said bracket is secured to said spring under tension.

15. An overhead garage door bottom bracket assembly for assisting the door lift in a spring tensioned system comprising:

a garage door bottom panel; and a garage door bottom bracket having first and second substantially perpendicularly intersecting planar surfaces, a ring integrally formed from and substantially perpendicular to said first planar surface for securing a standard door roller thereto, at least one slot in said first planar surface to permit passage of at least one threaded fastening device for releasably securing said bottom bracket to said bottom panel, an elongated body extending from said second planar surface for securing said bracket to a door lifting spring under tension, and means for releasably interlocking said bracket to the door bottom, said means adapted to interlock said bracket with the door bottom when said bracket is connected to the lift spring under tension and to be easily released from the door bottom when said bracket is not connected to the lift spring under tension.

16. The bracket assembly of claim 15 wherein said means for preventing said bracket from releasing said bottom panel comprises:

at least one male protrusion on said bracket; and at least one female receptacle on said bottom panel for interlocking said bracket to said bottom panel by sliding interference fit.

17. The bracket assembly of claim 16 wherein said male protrusion has a narrow throat and bulbous head and said female receptacle has a bulbous opening with a narrow slot extending therefrom;

said bulbous head adapted to be received by said bulbous opening; and said narrow throat adapted to be received by said narrow slot.

18. The bracket assembly of claim 17 wherein said narrow slot extends vertically upward from said bulbous opening.

19. The bracket assembly of claim 17 wherein the length of said narrow slot defines the full extent of said sliding interference fit.

20. The bracket of claim 16 wherein said female receptacles are located in the stile of said bottom panel and said male protrusions are located on said bracket second planar surface.

21. The bracket of claim 20 wherein said bottom panel is formed from a plastic or metal sheet.

22. The bracket assembly of claim 15 wherein said means for preventing said bracket from releasing said bottom panel comprises:

at least one female receptacle on said bracket; and at least one male protrusion on said bottom panel for interlocking said bracket to said bottom panel by sliding interference fit.

23. The bracket assembly of claim 22 wherein said male protrusion has a narrow throat and bulbous head and said female receptacle has a bulbous opening with a narrow slot extending therefrom;

said bulbous head adapted to be received by said bulbous opening; and said narrow throat adapted to be received by said narrow slot.

24. The bracket assembly of claim 23 wherein said narrow slot extends vertically downward from said bulbous opening.

25. The bracket of claim 24 wherein said male protusions are located on the stile of said bottom panel and said female receptacles are located in said bracket second planar surface.

26. The bracket of claim 25 wherein said bottom panel is formed from wood.

* * * * *